US011611831B1

(12) United States Patent
Petrenko et al.

(10) Patent No.: US 11,611,831 B1
(45) Date of Patent: Mar. 21, 2023

(54) ELECTRODYNAMIC ACTUATOR FOR ACOUSTIC OSCILLATIONS

(71) Applicant: FLATVOX FZC LLC, Ajman (AE)

(72) Inventors: Dmitry Vladimirovich Petrenko, Afipsky (RU); Mikhail Gorden, Dubai (AE)

(73) Assignee: FLATVOX FZC LLC, Ajman (AE)

( * ) Notice: Subject to any disclaimer, the term of this patent is extended or adjusted under 35 U.S.C. 154(b) by 0 days.

(21) Appl. No.: 17/953,542

(22) Filed: Sep. 27, 2022

(51) Int. Cl.

| | |
|---|---|
| ***H04R 9/06*** | (2006.01) |
| ***H04R 9/02*** | (2006.01) |
| ***H04R 9/04*** | (2006.01) |
| *H04R 7/04* | (2006.01) |

(52) U.S. Cl.
CPC ..... *H04R 9/025* (2013.01); *H04R 9/041* (2013.01); *H04R 9/046* (2013.01); *H04R 9/06* (2013.01); *H04R 9/063* (2013.01); *H04R 7/04* (2013.01); *H04R 2209/022* (2013.01); *H04R 2209/041* (2013.01)

(58) Field of Classification Search
CPC ..... H04R 9/025; H04R 9/046; H04R 9/047; H04R 9/06; H04R 9/063; H04R 2209/022; H04R 2209/041; H04R 2400/03
See application file for complete search history.

(56) References Cited

U.S. PATENT DOCUMENTS

| | | | | | |
|---|---|---|---|---|---|
| 4,609,784 | A * | 9/1986 | Miller | H04R 3/002 | 381/421 |
| 4,783,824 | A * | 11/1988 | Kobayashi | H04R 9/025 | 381/96 |
| 5,371,806 | A * | 12/1994 | Kohara | H04R 9/025 | 381/420 |
| 5,446,797 | A * | 8/1995 | Paddock | H04R 9/047 | 381/421 |
| 5,604,815 | A * | 2/1997 | Paddock | H04R 9/047 | 381/396 |

* cited by examiner

*Primary Examiner* — Huyen D Le
(74) *Attorney, Agent, or Firm* — Nadya Reingand

(57) ABSTRACT

The present disclosure relates to an electrodynamic actuator configured to operate within a wide frequency range up to the entire spectrum of audio frequencies (20 Hz to 20 KHz). The actuator comprises an open-ended hollow body, a package-type magnetic system comprising one or more pairs of magnets arranged in the hollow body, a sound-emitting membrane arranged externally to the hollow body, a support frame extending from the membrane into the hollow body and having two or more coils attached thereto, and conductive tracks connecting each of the coils with an AC power source. Each pair of magnets comprises two coaxially fixed magnets, one of which surrounds another in the form of a ring. There is a magnetic gap between the magnets in each pair of magnets. Moreover, the magnets in each pair of magnets have different magnetizations, so that their magnetic fields are directed in opposite directions.

15 Claims, 5 Drawing Sheets

ELECTRODYNAMIC ACTUATOR FOR ACOUSTIC OSCILLATIONS

TECHNICAL FIELD

The present disclosure relates generally to the field of acoustic devices. In particular, the present disclosure relates to an electrodynamic actuator for acoustic oscillations, which can be used in different (dynamic and flat-type) acoustic systems as well as in industry and mechanical engineering as a linear motor of periodic oscillations of a wide frequency range.

BACKGROUND

There is a range of commercially available electrodynamic actuators configured to operate as part of acoustic systems. For example, manufacturers of such actuators are represented by different companies, such as Amina, Billionsound, Dayton Audio, Monacor. However, the electrodynamic actuators produced by these companies have such a design that does not allow them to operate in a required frequency range and provides a relatively low efficiency. Moreover, most of the commercially available electrodynamic actuators are unable to operate efficiently at frequencies below 100 Hz in flat loudspeakers.

There are also electrodynamic actuators that allow one to work at frequencies from 50 Hz to 60 Hz, but, as a rule, such actuators have an increased inductance, which in turn reduces their upper frequency limit. At the same time, to achieve high-power acoustic characteristics with the aid of such actuators, it becomes necessary to use assemblies of several electrodynamic actuators on one sound membrane, which in turn leads to a deterioration in the acoustic qualities of a membrane-based acoustic system (e.g., a loudspeaker). There are several reasons for this deterioration. Multiple excitation sources or, in other words, actuators operating in phase lead to negative interference phenomena that add spurious harmonics and saturations to a sound picture, thereby "polluting" the sound of the acoustic system. The need to mount an assembly of several electrodynamic actuators on one panel leads to the blocking of large parts of the sound membrane and to the impossibility of providing the sound membrane with an optimal degree of freedom and a sufficient area for favorable conditions for the propagation of bending processes on the surface of the sound membrane, thereby making it impossible to provide the natural formation of regions of standing antiphase waves in a wide frequency spectrum on the surface of the sound membrane. Furthermore, the electrical connections of several electrodynamic actuators are usually made in a series-parallel manner to obtain required resistance characteristics for coordinated operation with amplifying techniques. This causes an increase in the overall inductance of the whole acoustic system, which again does not allow a fully wideband actuator to be created.

To ensure the full-range operation of the acoustic system, acoustical engineers have proposed to create multi-band solutions, i.e., a first electrodynamic actuator operates in a mid-frequency range, a second electrodynamic actuator operates in a high-frequency range, and a third electrodynamic actuator operates in a low-frequency range. This greatly complicates both the technical solution itself and the electronic equipment required to ensure the coordinated operation of such a system. Due to transients in the regions of overlapping frequencies of two or more electrodynamic actuators, it is difficult to ensure fully in-phase generation of pulses and oscillations from the electrodynamic actuators having different parameters: an inductance, mass of moving parts, effective stroke, power, resistance, etc. As a result, in some cases it turns out to be completely impossible to match impulse responses in the region of overlapping operation of the electrodynamic actuators at the same frequencies, which results in a decrease in the class of the acoustic system with a deterioration in its acoustic characteristics.

RU 2456764 (dated Jul. 20, 2012) describes a flat loudspeaker which is made in the form of a housing that comprises: a cylindrical coil fixed on a frame, a sound-emitting membrane attached to the frame, a magnetic system, a system for holding the coil in a magnetic gap, and flexible wires for supplying an electrical signal to the coil. However, this solution suffers from the following disadvantages: a limited electrical power and an insufficiently wide frequency range.

RU 2746441 (dated Apr. 14, 2021) discloses a star-shaped coil that can be used as part of an electrodynamic actuator configured to generate acoustic oscillations in a flat loudspeaker. The star-shaped coil allows one to increase the power of the electrodynamic actuator, while reducing the contact area between the electrodynamic actuator and an acoustic membrane, which undoubtedly improves the sound quality of the flat loudspeaker and reduces the weight and size of the flat loudspeaker. However, the disadvantage of the star-shaped coil is that it cannot operate in a wide-range frequency spectrum covering the entire sound spectrum from 20 Hz to 20 KHz. Therefore, the electrodynamic actuator provided with the star-shaped coil is applicable as part of multi-component acoustic systems only when a separate differently designed electrodynamic actuator is responsible for generating high frequencies (over 3000 Hz). All of this is associated with certain technical difficulties. The star-shaped coil is, in fact, an accordion-fold cylindrical coil having an increased diameter to provide its compactness. As well-known, the larger the diameter and the smaller the height with which a solenoid (electric coil) is wound, the higher the value of its inductance defined as follows:

$$L = \mu_0 n^2 V = \frac{\mu_0}{4\pi}\frac{z^2}{l},$$

where $\mu_0$ is the magnetic permeability of the vacuum, $n=N/l$ is the number of turns per unit length of the solenoid, N is the number of turns, $V=Sl$ is the volume of the solenoid, $z=\pi dN$ is the length of the conductor wound around the solenoid, $S=\pi d^2/4$ is the cross-sectional area of the solenoid, l is the solenoid length, and d is the diameter of the turn. Given the above formula, the inductance is determined by the ratio of the square of the length of the conductor or wire wound around the solenoid to the length of the solenoid. Thus, one can conclude that to generate higher frequencies in the form of mechanical oscillations, it is required to increase the inductance of the solenoid or coil by increasing its total winding length, while remaining the conductor length unchanged.

It should also be noted that, in practice, an electrodynamic actuator having a star-shaped coil (like the one disclosed in RU 2746441), which is designed with power parameters sufficient for operation in professional acoustic systems (100 W-1 KW), will have an inductance that does not allow generating frequencies above 1 kHz efficiently, which does not allow one to consider such an electrodynamic actuator as wideband.

SUMMARY

This summary is provided to introduce a selection of concepts in a simplified form that are further described below in the detailed description. This summary is not intended to identify key features of the present disclosure, nor is it intended to be used to limit the scope of the present disclosure.

It is an objective of the present disclosure to provide an electrodynamic actuator that is configured to operate within a wide frequency range up to the entire spectrum of audio frequencies (20 Hz to 20 KHz).

It is a further objective of the present disclosure to ensure a reduced contact patch of the application of acoustic oscillations generated by the electrodynamic actuator to a sound-emitting membrane, which in turn leads to increased acoustic qualities, significantly reduced non-linear harmonic distortion and the possibility of creating powerful high-quality acoustics.

The objectives above are achieved by the features of the independent claim in the appended claims. Further embodiments and examples are apparent from the dependent claims, the detailed description and the accompanying drawings.

According to an aspect, an electrodynamic actuator for acoustic oscillations is provided. The actuator comprises a hollow body having an open end and a pair of magnets arranged in the hollow body. The pair of magnets comprises a first magnet and a second magnet that have a different magnetization. The first magnet is annularly shaped, while the second magnet is annularly or cylindrically shaped and arranged inside and coaxially to the first magnet such that there is a gap between the first magnet and the second magnet. The actuator further comprises a sound-emitting membrane arranged externally to the hollow body near the open end of the hollow body. The actuator further comprises a support frame extending from the sound-emitting membrane into the hollow body. The support frame extends through the gap between the first magnet and the second magnet. The actuator further comprises a first coil attached to the support frame near one end of the gap and a second coil attached to the support frame near another end of the gap. The first coil and the second coil are oppositely oriented. The actuator is further provided with at least one conductive track connecting each of the first coil and the second coil to an AC power source. The first coil and the second coil are configured, when connected in series or in parallel to the AC power source, to produce oppositely directed magnetic fields. With this configuration, the actuator is per se a coaxial electrodynamic machine configured to efficiently generate acoustic oscillations in a wide frequency range (e.g., 20 Hz-20 KHz). Furthermore, in this configuration of the actuator, the entire frequency spectrum is transmitted to a single contact area with the sound-emitting membrane, which allows providing the maximum possible quality indicators of an acoustic system within which the actuator is to be used. On top of that, the actuator thus configured may allow one to make the acoustic system powerful, compact, and clear in sound.

In one exemplary embodiment, the actuator further comprises a first centering washer and a second centering washer. In this embodiment, the first centering washer is attached to the hollow body near the open end of the hollow body, while the second centering washer is arranged in the hollow body such that the first coil and the second coil are arranged between the first centering washer and the second centering washer. These washers may allow one to center the support frame with the first and second coils in the housing more easily.

In another exemplary embodiment, the actuator further comprises a first centering washer and a second centering washer. In this embodiment, the first centering washer is attached to the hollow body near the open end of the hollow body, while the second centering washer is arranged in the hollow body such that the first coil and the second coil are arranged below the second centering washer in the hollow body. This arrangement of the first and second washers may also simplify the centering of the support frame with the first and second coils in the housing.

In one exemplary embodiment, the support frame is shaped as a hollow cylinder having an inner surface. In this embodiment, each of the first coil and the second coil is attached to the inner surface of the hollow cylinder. The cylindrical support frame may easily extend through the gap between the first and second magnets, while providing a sufficient mounting surface for the first and second coils.

In one exemplary embodiment, the first coil and the second coil differ from each other in at least one of: a diameter of a coil wire; a length of the coil wire; a resistance of the coil wire; a material of the coil wire; coil dimensions; a coil shape; a coil inductance; and a coil magnetization. By using the first and second coils with different characteristics, it is possible to make them operative in different frequency ranges.

In one exemplary embodiment, the first coil and the second coil differ from each other in the coil dimensions. In this embodiment, the pair of magnets is configured such that the gap between the first magnet and the second magnet has a variable cross-section. By using the variable gap and the differently sized coils, it is possible to properly change the frequency characteristics of the actuator and, consequently, the acoustic system in which it is used.

In one exemplary embodiment, the coil dimensions of the first coil are smaller than the coil dimensions of the second coil. In this embodiment, the gap between the first magnet and the second magnet increases towards the second coil. In this embodiment, the first coil and second coil may operate in high-frequency and low-frequency ranges, respectively, thereby allowing the actuator to operate more efficiently.

In one exemplary embodiment, the actuator further comprises an additional pair of magnets and an additional coil. The additional pair of magnets is arranged in the hollow body parallel to and at a distance from the pair of magnets. The additional pair of magnets comprises a first additional magnet and a second additional magnet that have a different magnetization. The first additional magnet is annularly shaped, while the second additional magnet is annularly or cylindrically shaped and arranged inside and coaxially to the first additional magnet such that there is a gap between the first additional magnet and the second additional magnet. The magnetization of the first additional magnet is opposite to the magnetization of the first magnet and the magnetization of the second additional magnet is opposite to the magnetization of the second magnet. In this embodiment, the support frame additionally extends through the gap between the first additional magnet and the second additional magnet. The additional pair of magnets is further arranged in the hollow body such that one of the first coil and the second coil is arranged near one end of the gap between the first additional magnet and the second additional magnet. The additional coil is attached to the support frame such that the additional coil is arranged near another end of the gap between the first additional magnet and the second additional magnet. The additional coil is connected to the AC power source by using the at least one conductive track. The first coil, the second coil and the additional coil are configured, when connected in series or in parallel to the AC power source, to produce oppositely directed magnetic fields. By using the additional pair of magnets and the additional coil, it is possible to extend the operational frequency range of the actuator. As a result, this may make the actuator more powerful and may reduce the contact area with the sound-emitting membrane even more.

In one exemplary embodiment, the gap between the first additional magnet and the second additional magnet is identical to the gap between the first magnet and the second magnet. In this embodiment, the gaps are the same, but the coils may be configured differently (e.g., made of different wire materials and with different coil dimensions) to provide a desired wire frequency range within which the actuator is able to operate. This embodiment may be useful when it is difficult to provide different gaps in the pairs of magnets from the technological point of view.

In another exemplary embodiment, the gap between the first additional magnet and the second additional magnet differs from the gap between the first magnet and the second magnet. In this embodiment, each of the pairs of magnets may be used for its own different (e.g., non-overlapping) frequency range.

In one exemplary embodiment, the hollow body is made of a nonmagnetic material. Such a body will not influence the properties of the magnets and coils used therein, thereby improving the operation of the actuator (i.e., its frequency characteristics).

In one exemplary embodiment, each of the first magnet and the second magnet is made of a low-electrical-conductivity material (or, in other words, a high-electrical-resistance material). For example, the first and second magnets may be ferrite magnets, magnets made using the technology of pressing powder metals (including neodymium), magnets made in a stacked manner based on thin magnetic layers electrically isolated from each other, or polymer magnets. With these magnets, the actuator may properly operate in the desired frequency range.

In one exemplary embodiment, each of the first additional magnet and the second additional magnet is made of a low-electrical-conductivity material (or, in other words, a high-electrical-resistance material). For example, the first and second additional magnets may be ferrite magnets, magnets made using the technology of pressing powder metals (including neodymium), magnets made in a stacked manner based on thin magnetic layers electrically isolated from each other, or polymer magnets. With these magnets, the actuator may properly operate in the desired frequency range.

In one exemplary embodiment, the additional coil differs from each of the first coil and the second coil in at least one of: a diameter of a coil wire; a length of the coil wire; a resistance of the coil wire; a material of the coil wire; coil dimensions; a coil shape; a coil inductance; and a coil magnetization. By using the first, second and additional coils with different characteristics, it is possible to make them operative in different frequency ranges.

In one exemplary embodiment, the hollow body has an inner surface, and each of the first coil and the second coil (and the additional coil, if any) is wound in a direction from the inner surface of the hollow body. This winding direction may lead to better cooling of the coils during their operation, as well as improve their endurance and mechanical stability.

Other features and advantages of the present disclosure will be apparent upon reading the following detailed description and reviewing the accompanying drawings.

BRIEF DESCRIPTION OF THE DRAWINGS

The present disclosure is explained below with reference to the accompanying drawings in which.

DETAILED DESCRIPTION

Figure 1:
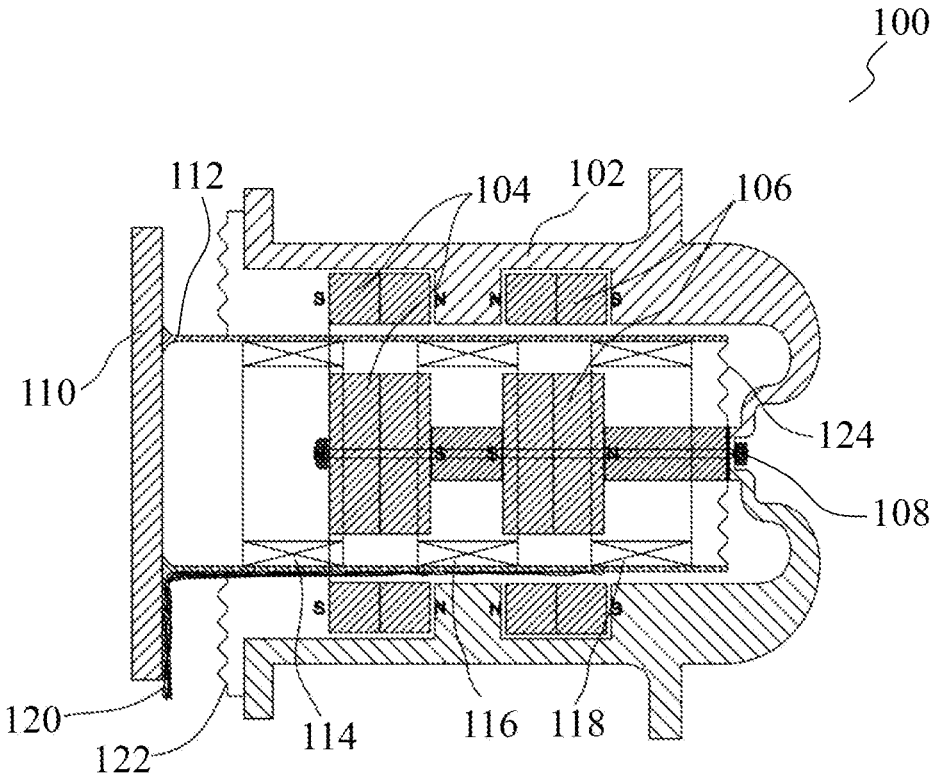
FIG. 1 shows a schematic block diagram of an electrodynamic actuator in accordance with a first exemplary embodiment.

Various embodiments of the present disclosure are further described in more detail with reference to the accompanying drawings. However, the present disclosure may be embodied in many other forms and should not be construed as limited to any certain structure or function discussed in the following description. In contrast, these embodiments are provided to make the description of the present disclosure detailed and complete.

According to the detailed description, it will be apparent to the ones skilled in the art that the scope of the present disclosure encompasses any embodiment thereof, which is disclosed herein, irrespective of whether this embodiment is implemented independently or in concert with any other embodiment of the present disclosure. For example, the apparatus disclosed herein may be implemented in practice by using any numbers of the embodiments provided herein. Furthermore, it should be understood that any embodiment of the present disclosure may be implemented using one or more of the features presented in the appended claims.

The word "exemplary" is used herein in the meaning of "used as an illustration". Unless otherwise stated, any embodiment described herein as "exemplary" should not be construed as preferable or having an advantage over other embodiments.

Any positioning terminology, such as "left", "right", "top", "bottom", "above" "below", "upper", "lower", "horizontal", "vertical", etc., may be used herein for convenience to describe one element's or feature's relationship to one or more other elements or features in accordance with the figures. It should be apparent that the positioning terminology is intended to encompass different orientations of the apparatus disclosed herein, in addition to the orientation(s) depicted in the figures. As an example, if one imaginatively rotates the apparatus in the figures 90 degrees clockwise, elements or features described as "left" and "right" relative to other elements or features would then be oriented, respectively, "above" and "below" the other elements or features. Therefore, the positioning terminology used herein should not be construed as any limitation of the invention.

Although the numerative terminology, such as "first", "second", etc., may be used herein to describe various embodiments, elements or features, these embodiments, elements or features should not be limited by this numerative terminology. This numerative terminology is used herein only to distinguish one embodiment, element or feature from another embodiment, element or feature. For example, a first magnet discussed below could be called a second magnet, and vice versa, without departing from the teachings of the present disclosure.

The exemplary embodiments disclosed herein relate to an electrodynamic actuator that comprises the following structural elements: an open-ended hollow body, a package-type magnetic system comprising one or more pairs of magnets arranged in the hollow body, a sound-emitting membrane arranged externally to the hollow body, a support frame extending from the membrane into the hollow body and having two or more coils attached thereto, and conductive tracks connecting each of the coils with an AC power source. Each pair of magnets comprises two coaxially fixed (e.g., permanent) magnets, one of which surrounds another in the form of a ring. There is a magnetic gap between the magnets in each pair of magnets. Moreover, the magnets in each pair of magnets have different magnetizations, so that their magnetic fields are directed in opposite directions. The support frame extends through the gap such that each pair of magnets is provided with the two adjacent coils arranged near the opposite ends of the gap (e.g., each of the coils may be arranged partly in the gap). The coils are wound and connected to the AC power source such that their magnetic fields are oppositely directed. In other words, the coils are oppositely oriented in each pair of magnets. For example, when the AC power source feeds a first half-wave of a sinusoidal electrical signal to the coils, the force of magnetic interaction occurs, which simultaneously draws one of the coils into the gap and pushes another of the coils out of the gap. With this configuration, the actuator may efficiently generate acoustic oscillations in a wide frequency range (e.g., 20 Hz-20 KHz). Furthermore, in this configuration of the actuator, the entire frequency spectrum is transmitted to a single contact area with the sound-emitting membrane, which allows providing the maximum possible quality indicators of an acoustic system within which the actuator is to be used. On top of that, the actuator thus configured may allow one to make the acoustic system powerful, compact, and clear in sound.

FIG. 1 shows a schematic block diagram of an electrodynamic actuator 100 in accordance with a first exemplary embodiment. The actuator 100 comprises a hollow body 102 having an open (left) end, as well as a first pair 104 of magnets and a second pair 106 of magnets which are arranged in the hollow body 102 at a distance from each other. More specifically, the pairs 104, 106 of magnets are fixed coaxially with each other. Preferably, the hollow body 102 is made of a nonmagnetic material. Each of the pairs 104, 106 of magnets comprises a first (external) magnet and a second (internal) magnet that have different magnetizations (see magnet poles "S" and "N" in FIG. 1). The first magnet is annularly shaped, while the second magnet is annularly or cylindrically shaped and arranged inside and coaxially to the first magnet such that there is a gap between the first and second magnets. Such an arrangement of the second magnet may be provided, for example, by using a rod or bar 108 extending from the bottom of the hollow body 102 towards its open end. As for the first magnet, it may be arranged on protrusions or recesses provided on the inner surface of the hollow body 102. The gaps in each of the pairs 104, 106 of magnets may be the same or different, depending on particular applications. It should be noted that one of the first and second magnets in at least one of the first and second pairs 104, 106 of magnets may be replaced by some ferromagnetic material. In general, brands of magnets and ferromagnetic elements for the pairs 104, 106 of magnets may be selected based the desire to obtain the lowest possible electrical conductivity of substance. By so doing, it is possible to increase the efficiency of converting electrical impulses into mechanical oscillations of coils (discussed below) by reducing the formation of Foucault eddy currents induced in each of the pairs 104, 106 of magnets under the action of magnetic lines of force of the coils that rapidly change in time and space.

As also shown in FIG. 1, the actuator 100 further comprises a sound-emitting membrane 110 arranged externally to the hollow body 102 near its open end, as well as a support frame 112 extending from the sound-emitting membrane 110 into the hollow body 102. The support frame 112 extends through the gap between the first and second magnets in each of the pairs 104, 106 of magnets. Preferably, the support frame 112 has a cylindrical shape. The support frame 112 is provided with three oppositely oriented (i.e., differently wound) coils 114, 116 and 118. The coil 114 is attached to the support frame 112 near one (left) end of the gap provided in the pair 104 of magnets. The coil 116 is attached to the support frame 112 near another (right) end of the gap provided in the pair 104 of magnets and, at the same time, near one (left) end of the gap provided in the pair 106 of magnets. The coil 118 is attached to the support frame 112 near another (right) end of the gap provided in the pair 106 of magnets. Each of the coils 114, 116, and 118 may partly extend in the corresponding gap. The distance between the pairs 104, 106 of magnets may be selected such that the coil 116 partly extends in each of the gaps provided in the pairs 104, 106 of magnets. Each of the coils 114, 116, and 118 is connected to an AC power source (not shown in FIG. 1) by using one or more conductive tracks 120 (e.g., planar tracks) fixed on the sound-emitting membrane 110 as an integral part thereof. Moreover, the coils 114, 116, and 118 are configured to produce oppositely directed magnetic fields in response to an electrical signal fed from the AC power source, which is effective in terms of transforming, by the coils 114, 116, and 118, electrical energy into mechanical energy of oscillations.

The actuator 100 may optionally comprise a first centering washer 122 and a second centering washer 124 which may facilitate centering of the support frame 112 (and, consequently, the coils 114, 116, and 118) in the hollow body 102. In the embodiment shown in FIG. 1, the first centering washer 122 is attached to the hollow body 102 near its open end, while the second centering washer 124 is arranged at or near the bottom of the hollow body 102 such that the coils 114, 116, and 118 are arranged between the first centering washer 122 and the second centering washer 124.

In one embodiment, the coils 114, 116, and 118 may differ from each other in at least one of the following parameters: a diameter of a coil wire; a length of the coil wire; a resistance of the coil wire; a material of the coil wire; coil dimensions; a coil shape; a coil inductance; and a coil magnetization. In this embodiment, each of the coils 114, 116, and 118 may be operative in a different frequency range.

In one exemplary embodiment, each of the coils 114, 116, and 118 may be wound in a direction from the inner surface of the hollow body 102. This winding direction may lead to better cooling of the coils 114, 116, and 118 during their operation, as well as improve their endurance and mechanical stability.

Figure 2:
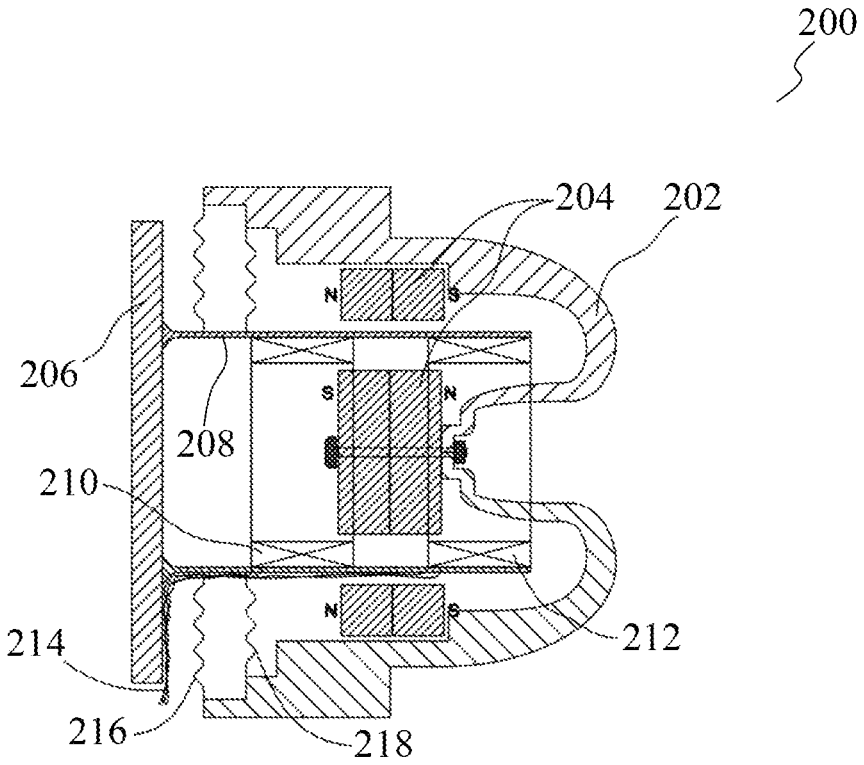
FIG. 2 shows a schematic block diagram of an electrodynamic actuator in accordance with a second exemplary embodiment.

FIG. 2 shows a schematic block diagram of an electrodynamic actuator 200 in accordance with a second exemplary embodiment. The actuator 200 comprises a hollow (e.g., nonmagnetic) body 202 having an open (left) end and a single pair 204 of magnets arranged in the hollow body 202. Similar to the pairs 104, 106 of magnets, the pair 204 of magnets comprises a first (external) magnet and a second (internal) magnet that have different magnetizations (see magnet poles "S" and "N" in FIG. 2). The first and second magnets of the pair 204 of magnets may be implemented and arranged in the hollow body 202 in the same or similar way as those of the pairs 104, 106 of magnets in the hollow body 102. As also shown in FIG. 2, the actuator 200 further comprises a sound-emitting membrane 206 arranged externally to the hollow body 202 near its open end, as well as a support frame 208 (e.g., in the form of a hollow cylinder) extending from the sound-emitting membrane 206 into the hollow body 202. The support frame 208 extends through the gap between the first and second magnets of the pair 204 of magnets. The support frame 208 is provided with two oppositely oriented (i.e., differently wound) coils 210 and 212. The coil 210 is attached to the support frame 208 near one (left) end of the gap provided in the pair 204 of magnets. The coil 212 is attached to the support frame 208 near another (right) end of the gap provided in the pair 204 of magnets. Each of the coils 210 and 212 may partly extend in the gap. Again, each of the coils 210 and 212 is assumed to be connected to an AC power source (not shown in FIG. 2) by using one or more conductive tracks 214 (e.g., planar tracks) fixed on the sound-emitting membrane 206 as an integral part thereof. Moreover, the coils 210 and 212 are configured to produce oppositely directed magnetic fields in response to an electrical signal fed from the AC power source, which is effective in terms of transforming, by the coils 210 and 212, electrical energy into mechanical energy of oscillations. Similar to the coils 114, 116, and 118, the coils 210 and 212 may differ from each other in at least one of the following parameters: a diameter of a coil wire; a length of the coil wire; a resistance of the coil wire; a material of the coil wire; coil dimensions; a coil shape; a coil inductance; and a coil magnetization.

Similar to the actuator 100, the actuator 200 may optionally comprise a first centering washer 216 and a second centering washer 218 which may facilitate centering of the support frame 208 (and, consequently, the coils 210 and 212) in the hollow body 202. Unlike the first embodiment, in the second embodiment the first centering washer 216 and the second centering washer 218 are both attached to the hollow body 202 near its open end, so that the coils 210 and 212 are arranged after (i.e., below or on the right side of) the second centering washer 218.

Figure 3:
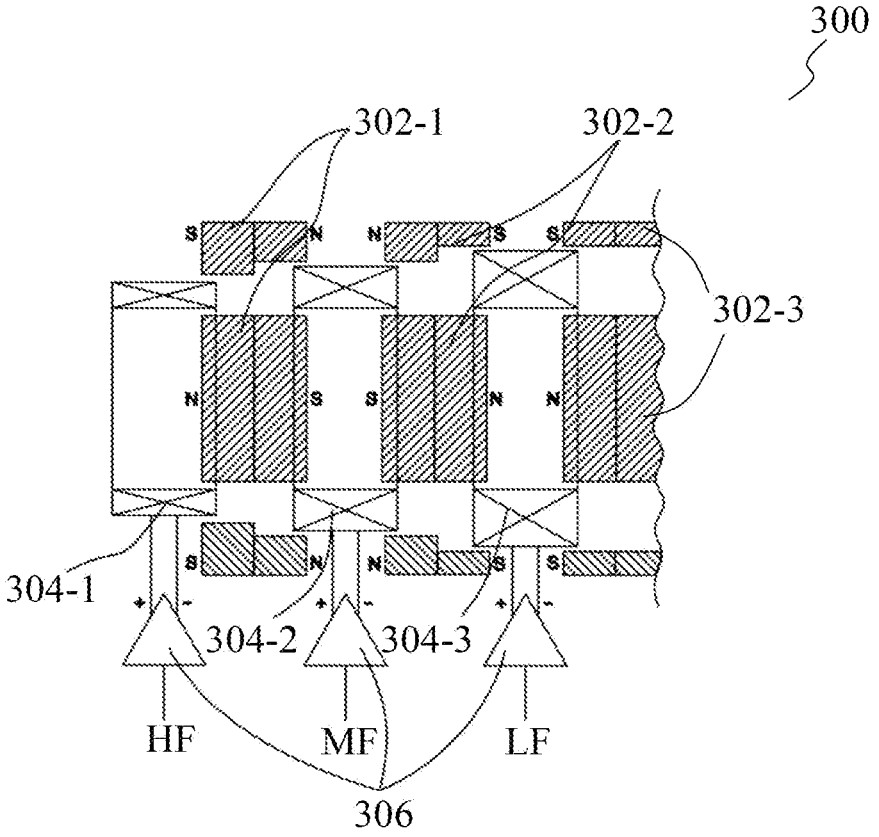
FIG. 3 shows a schematic block diagram of an electrodynamic actuator in accordance with a third exemplary embodiment.

FIG. 3 shows a schematic block diagram of an electrodynamic actuator 300 in accordance with a third exemplary embodiment. The actuator 300 comprises an open-ended hollow (e.g., nonmagnetic) body (not shown in FIG. 3) and a set of pairs 302-1, 302-2, 302-3 of magnets arranged in the hollow body. The pairs 302-1, 302-2, 302-3 of magnets may be equally or differently spaced from each other, depending on particular applications. Moreover, there can be more than three pairs of magnets in the actuator 300, as should obvious to those skilled in the art. Similar to the pairs 104, 106 of magnets, each of the pairs 302-1, 302-2, 302-3 of magnets comprises a first (external) magnet and a second (internal) magnet that have different magnetizations (see magnet poles "S" and "N" in FIG. 3). The first and second magnets of each of the pairs 302-1, 302-2, 302-3 of magnets may be implemented and arranged in the hollow body in the same or similar way as those of the pairs 104, 106 of magnets in the hollow body 102. The actuator 300 is also assumed to comprise a sound-emitting membrane arranged externally to the hollow body near its (e.g., left) open end, as well as a support frame (e.g., in the form of a hollow cylinder) extending from the sound-emitting membrane into the hollow body. Both the membrane and the support frame are not shown in FIG. 3 in order not to overload the figure. The support frame is assumed to extend through the gap between the first and second magnets of each of the pairs 302-1, 302-2, 302-3 of magnets. As also shown in FIG. 3, the actuator 300 further comprises a set of four coils which are assumed to be attached to the support frame. The four coils comprise coils 304-1, 304-2, 304-3, as well as one more coil not shown in FIG. 3 and arranged after (below or on the right side of) the pair 302-3 of magnets. In general, the number of coils should exceed the number of pairs of magnets by 1. Each two adjacent coils of the set of the coils 304-1, 304-2, and 304-3 are oppositely oriented (i.e., differently wound). The four coils may be arranged in the hollow body in the same or similar way as the coils 114, 116, and 118 in the hollow body 102. For example, each of the four coils may partly extend into the corresponding gap(s) of the pairs 302-1, 302-2, 302-3 of magnets. The actuator 300 further comprises a set 306 of (four) AC power sources (e.g., AC amplifiers) each connected to one of the four coils by using one or more conductive tracks (e.g., planar tracks) that may be fixed on the membrane as an integral part thereof. Each adjacent two of the four coils in the actuator 300 are configured to produce oppositely directed magnetic fields in response to an electrical signal fed from the corresponding AC power sources.

Unlike the first and second embodiments, in the third embodiment the four coils have different coil dimensions, for which reason the gap in each of the pairs 302-1, 302-2, 302-3 of magnets has a variable cross-section. More specifically, the coil dimensions increase from one coil to another (i.e., in the direction from the coil 304-1 to the fourth coil). However, such a change in the coil dimensions should not be construed as any limitation of the present disclosure. In some other embodiments, the coil dimensions may decrease from the coil 304-1 to the fourth coil. If there are N coils in the actuator 300, they may be divided into (equally or differently sized) subsets, in each of which a change in the coil dimensions may be implemented in a certain direction (e.g., if there are three such subsets, the coil dimensions may increase towards the open end of the hollow body in two of them, while the coil dimensions may increase towards the bottom of the hollow body).

When the coil dimensions increase in the direction from the coil 304-1 to the fourth coil (as shown in FIG. 3), the coil closest to the membrane, i.e., the coil 304-1, has the lowest inductance, which allows it to operate in a high-frequency (HF) range. The proximity of the coil 304-1 to the membrane makes it possible to effectively transmit HF oscillations to the membrane for subsequent re-radiation into the air space. In this case, the second coil, i.e., the coil 304-2, has such an inductance that allows it to operate in a mid-frequency (MF) or low-frequency (LF) range. Finally, each of the third coil, i.e., the coil 304-3, and the fourth coil (not shown in FIG. 3) has such an inductance that allows it to operate in the LF range. If required, the third and fourth coils or a series of subsequent coils (if any) may be wound with parameters that allow implementing a sub-LF range at high power. It should be noted that the order of the coils with different properties, which are mounted on the single cylindrical frame support, may be different from the one shown in FIG. 3, depending on particular applications (e.g., acoustical tasks to be solved). Even in the case of using coils with the same parameters, it is possible to reduce the overall inductance of the whole magnetic system. Thus, it becomes possible to create a powerful electrodynamic actuator with the ability to operate in an extended frequency range.

Figure 4:
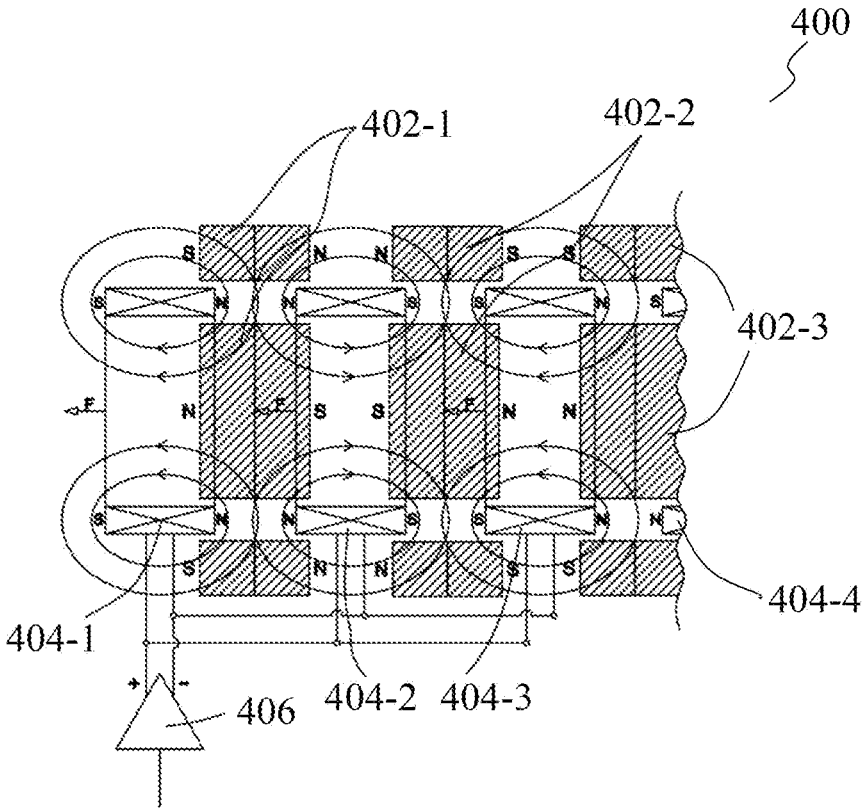
FIG. 4 shows a schematic block diagram of an electrodynamic actuator in accordance with a fourth exemplary embodiment.

FIG. 4 shows a schematic block diagram of an electrodynamic actuator 400 in accordance with a fourth exemplary embodiment. The actuator 400 comprises an open-ended hollow (e.g., nonmagnetic) body (not shown in FIG. 4) and a set of pairs 402-1, 402-2, 402-3 of magnets arranged in the hollow body. The pairs 402-1, 402-2, 402-3 of magnets may be equally or differently spaced from each other, depending on particular applications. Moreover, there can be more than three pairs of magnets in the actuator 400, as should obvious to those skilled in the art. Similar to the pairs 104, 106 of magnets, each of the pairs 402-1, 402-2, 402-3 of magnets comprises a first (external) magnet and a second (internal) magnet that have different magnetizations (see magnet poles "S" and "N" in FIG. 4). The first and second magnets of each of the pairs 402-1, 402-2, 402-3 of magnets may be implemented and arranged in the hollow body in the same or similar way as those of the pairs 104, 106 of magnets in the hollow body 102. The actuator 400 is also assumed to comprise a sound-emitting membrane arranged externally to the hollow body near its (e.g., left) open end, as well as a support frame (e.g., in the form of a hollow cylinder) extending from the sound-emitting membrane into the hollow body. Both the membrane and the support frame are not shown in FIG. 4 in order not to overload the figure. The support frame is assumed to extend through the gap between the first and second magnets of each of the pairs 402-1, 402-2, 402-3 of magnets. As also shown in FIG. 4, the actuator 300 further comprises a set of four coils 404-1, 404-2, 404-3, and 404-4 which are assumed to be attached to the support frame. Each two adjacent coils of the set of the coils 404-1, 404-2, 404-3, and 404-4 are oppositely oriented (i.e., differently wound). The coils 404-1, 404-2, 404-3, and 404-4 may be arranged in the hollow body in the same or similar way as the coils 114, 116, and 118 in the hollow body 102. For example, each of the four coils may partly extend into the corresponding gap(s) of the pairs 402-1, 402-2, 402-3 of magnets.

Unlike the third embodiment but similar to the first embodiment, in the fourth embodiment the four coils 404-1, 404-2, 404-3, and 404-4 have the same different coil dimensions, for which reason the gap in each of the pairs 402-1, 402-2, 402-3 of magnets has an identical constant cross-section. Furthermore, unlike the third embodiment, in the fourth embodiment the actuator 400 comprises a single AC power source (e.g., AC amplifier) connected to each of the four coils 404-1, 404-2, 404-3, and 404-4 by using one or more conductive tracks (e.g., planar tracks) that may be fixed on the membrane as an integral part thereof. In response to an electrical signal from the AC power source, each adjacent two of the four coils 404-1, 404-2, 404-3, and 404-4 are configured to produce oppositely directed magnetic fields, as schematically shown by circular arrows in FIG. 4.

Figure 5:
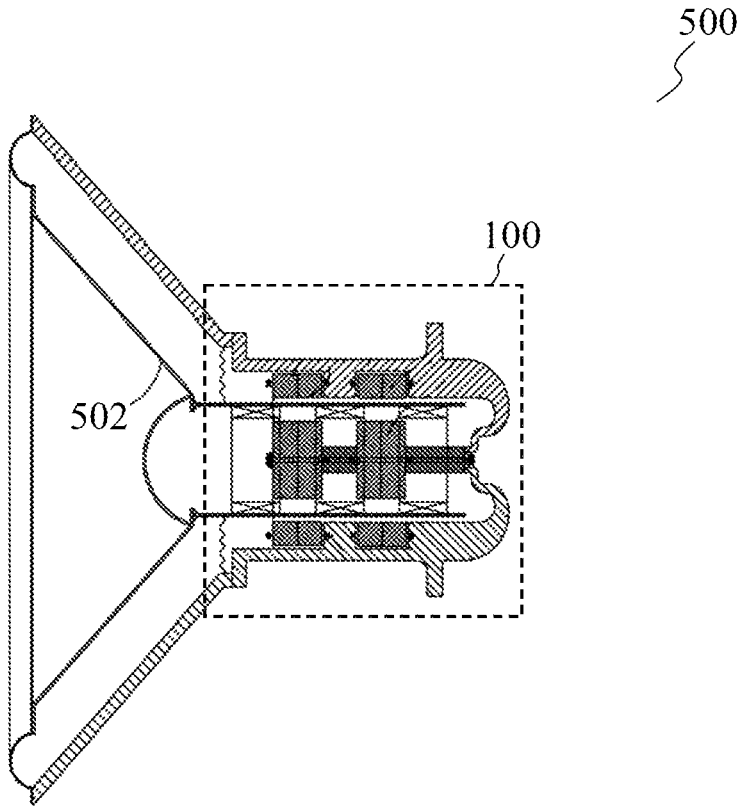
FIG. 5 shows a schematic block diagram of an acoustic speaker comprising the actuator of FIG. 1 in accordance with one exemplary embodiment.

FIG. 5 shows a schematic block diagram of an acoustic speaker 500 comprising the actuator 100 in accordance with one exemplary embodiment. More specifically, the acoustic speaker 500 comprises all the constructive elements of the actuator 100, except for the membrane 108 which is replaced with a membrane 502.

Although the exemplary embodiments of the present disclosure are described herein, it should be noted that any various changes and modifications could be made in the embodiments of the present disclosure, without departing from the scope of legal protection which is defined by the appended claims. In the appended claims, the word "comprising" does not exclude other elements or operations, and the indefinite article "a" or "an" does not exclude a plurality. The mere fact that certain measures are recited in mutually different dependent claims does not indicate that a combination of these measures cannot be used to advantage.

What is claimed is:

1. An electrodynamic actuator for acoustic oscillations, comprising:

a hollow body having an open end;

a pair of magnets arranged in the hollow body, the pair of magnets comprising a first magnet and a second magnet that have a different magnetization, the first magnet being annularly shaped, the second magnet being annularly or cylindrically shaped and arranged inside and coaxially to the first magnet such that there is a gap between the first magnet and the second magnet;

a sound-emitting membrane arranged externally to the hollow body near the open end of the hollow body;

a support frame extending from the sound-emitting membrane into the hollow body, the support frame extending through the gap between the first magnet and the second magnet;

a first coil attached to the support frame near one end of the gap;

a second coil attached to the support frame near another end of the gap; and at least one conductive track connecting each of the first coil and the second coil with an AC power source;

wherein the first coil and the second coil are configured, when connected in series or in parallel to the AC power source, to produce oppositely directed magnetic; wherein the first coil and the second coil differ from each other in coil dimensions, and wherein the pair of magnets is configured such that the gap between the first magnet and the second magnet has a variable cross-section.

2. The actuator of claim 1, further comprising:

a first centering washer attached to the hollow body near the open end of the hollow body; and a second centering washer arranged in the hollow body such that the first coil and the second coil are arranged between the first centering washer and the second centering washer.

3. The actuator of claim 1, further comprising:

a first centering washer attached to the hollow body near the open end of the hollow body; and a second centering washer arranged in the hollow body such that the first coil and the second coil are arranged below the second centering washer in the hollow body.

4. The actuator of claim 1, wherein the support frame is shaped as a hollow cylinder having an inner surface, and wherein each of the first coil and the second coil is attached to the inner surface of the hollow cylinder.

5. The actuator of claim 1, wherein the first coil and the second coil differ from each other in at least one of:

a diameter of a coil wire;

a length of the coil wire;

a resistance of the coil wire;

a material of the coil wire;

a coil shape;

a coil inductance; and a coil magnetization.

6. The actuator of claim 1, wherein the coil dimensions of the first coil are smaller than the coil dimensions of the second coil, and wherein the gap between the first magnet and the second magnet increases towards the second coil.

7. The actuator of claim 1, further comprising:

an additional pair of magnets arranged in the hollow body parallel to and at a distance from the pair of magnets, the additional pair of magnets comprising a first additional magnet and a second additional magnet that have a different magnetization, the first additional magnet being annularly shaped, the second additional magnet being annularly or cylindrically shaped and arranged inside and coaxially to the first additional magnet such that there is a gap between the first additional magnet and the second additional magnet, the magnetization of the first additional magnet being opposite to the magnetization of the first magnet and the magnetization of the second additional magnet being opposite to the magnetization of the second magnet, the support frame additionally extending through the gap between the first additional magnet and the second additional magnet, and the additional pair of magnets being further arranged in the hollow body such that one of the first coil and the second coil is arranged near one end of the gap between the first additional magnet and the second additional magnet; and an additional coil attached to the support frame such that the additional coil is arranged near another end of the gap between the first additional magnet and the second additional magnet;

wherein the additional coil is connected to the AC power source by using the at least one conductive track; and wherein the first coil, the second coil and the additional coil are configured, when connected in series or in parallel to the AC power source, to produce oppositely directed magnetic fields.

8. The actuator of claim 7, wherein the gap between the first additional magnet and the second additional magnet is identical to the gap between the first magnet and the second magnet.

9. The actuator of claim 7, wherein the gap between the first additional magnet and the second additional magnet differs from the gap between the first magnet and the second magnet.

10. The actuator of claim 7, wherein each of the first additional magnet and the second additional magnet is made of a low-electrical-conductivity material.

11. The actuator of claim 7, wherein the additional coil differs from each of the first coil and the second coil in at least one of:

a diameter of a coil wire;
a length of the coil wire;
a resistance of the coil wire;
a material of the coil wire;
coil dimensions;
a coil shape;
a coil inductance; and
a coil magnetization.

12. The actuator of claim 7, wherein the hollow body has an inner surface, and wherein each of the first coil, the second coil and the additional coil is wound in a direction from the inner surface of the hollow body.

13. The actuator of claim 1, wherein the hollow body is made of a nonmagnetic material.

14. The actuator of claim 1, wherein each of the first magnet and the second magnet is made of a low-electrical-conductivity material.

15. The actuator of claim 1, wherein the hollow body has an inner surface, and wherein each of the first coil and the second coil is wound in a direction from the inner surface of the hollow body.

* * * * *